United States Patent [19]

Lee

[11] 4,314,878

[45] Feb. 9, 1982

[54] METHOD OF OPERATING A PAPERMACHINE DRYING LINE

[75] Inventor: Hong H. Lee, Gainesville, Fla.

[73] Assignee: Westvaco Corporation, New York, N.Y.

[21] Appl. No.: 38,406

[22] Filed: May 14, 1979

Related U.S. Application Data

[63] Continuation of Ser. No. 872,379, Jan. 26, 1978, abandoned.

[51] Int. Cl.[3] ..... D21F 5/04; D21F 5/06

[52] U.S. Cl. ..... 162/198; 34/41; 34/48; 162/252; 162/253; 162/DIG. 11; 364/471

[58] Field of Search ..... 162/198, DIG. 11, 252, 162/DIG. 10, 263, 253, 290; 34/48, 26, 119, 30, 124, 31, 41; 364/471

[56] References Cited

U.S. PATENT DOCUMENTS

| | | | |
|---|---|---|---|
| 3,056,213 | 10/1962 | Kellogg | 34/23 |
| 3,490,689 | 1/1970 | Hart et al. | 162/DIG. 11 |
| 3,711,687 | 1/1973 | Stout et al. | 162/DIG. 11 |
| 3,846,231 | 11/1974 | Crosby et al. | 162/DIG. 10 |

OTHER PUBLICATIONS

Massey Jr., "Goal: Computer Control From 1 Year of Order . . . " *Pulp and Paper;* Apr. 1970.

Ekstram et al., "Automating the Control Loops on a Swedish Kraft Paper Machine"; *Pulp and Paper;* Apr. 3, 1967.

Meisel "Analog Computer Simulation of Paper Drying" *Tappi;* vol. 60, No. 1; 1977.

*Primary Examiner*—S. Leon Bashore
*Assistant Examiner*—Steve Alvo
*Attorney, Agent, or Firm*—W. Allen Marcontell; Richard L. Schmalz

[57] ABSTRACT

A particular papermachine and type of pulp stock for forming a particular basis weight web are analyzed for deriving a correlation between pulp stock drainage rate and the lowest obtainable critical moisture content of said paper web. From knowledge of the lowest critical moisture content and main steam pressure, differential pressure values between the several dryer pressure sections of the papermachine are determined for drying said web along the most energy-efficient drying rate trajectory. Also disclosed is a dryer steam pressure differential control program for maintenance of a predetermined magnitude of condensate inventory within the drying cylinders under normal running conditions and under conditions of interrupted web continuity.

4 Claims, 11 Drawing Figures

METHOD OF OPERATING A PAPERMACHINE DRYING LINE

This is a continuation, of application Ser. No. 872,379, filed Jan. 26, 1978 now abandoned.

BACKGROUND OF THE INVENTION

1. Field of the Invention

The present invention relates to the art of papermaking. More specifically, the present invention relates to the art of papermachine dryer regulation by means of automatic data process and control devices.

2. Description of the Prior Art

From an overall, simplified perspective, the manufacture of paper from wood fiber is a drying process. Prepared stock comprising a dilute aqueous slurry of wood fiber is directed onto a traveling screen for an initial, gross separation of water from fiber. As the water flows through the screen openings, constituent fiber is accumulated and retained on the screen surface to form a wet, fibrous mat. Additional water is subsequently removed from the mat by mechanical pressing.

Screening and pressing steps remove approximately 96% of the water initially present in the original slurry leaving a consolidated paper web containing approximately 63% water and 37% dry fiber. Since a satisfactory finished paper web should contain approximately only 5% water in relation to the dry fiber weight, such additional water removal is normally accomplished by means of thermal vaporization. For this purpose, the web is passed in intimate surface contact over a successive series of steam heated, rotating cylinders, such web being pressed against the hot surface of each cylinder about a major portion of the circumferential arc by an overlying web of woven fabric.

Contemporary papermachine design practice divides the 70 to 100 cylinders of the drying portion of a papermachine into three or more sections for the purpose of steam distribution and management. For reasons to be explained, the final steam section of the dryer sequence relative to the paper web progression is provided the highest temperature steam and the greater proportionate share of the available steam energy. As the steam flow progresses counterflow of the web travel through the several sections of the machine dryers toward the wet press end, dryer cylinder surface temperature decreases. The control mechanics of such temperature management is by means of pressure differential regulation across the several steam distribution sections of the dryer line. Utilization efficiency of the available steam energy is, of course, the objective of such pressure and temperature management strategy but the rational support of such strategy relates to the micro-mechanics of the web drying process.

Since the web is extremely wide in relation to the thickness thereof, only the wide surfaces are available for water vapor transpiration from the web envelope to the surrounding atmosphere. Upon reaching thermodynamic drive conditions relative to the surrounding atmosphere, water present at or near the surface of a saturated web is vaporized first, leaving interstitial capacity at the web surface to receive, by capillary migration, additional water from the web interior. Under constant (relative to time) thermodynamic drive conditions, the aforedescribed vaporizing mechanism will progress at an approximately constant rate in terms of water mass removal per unit of time and surface area.

After this drying process has progressed a certain degree toward completion, however, the rate of water removal begins to diminish. The water content of the web at this point of removal rate diminution is characterized as the critical moisture content. If a lower final moisture content of the web is desired, the thermodynamic drive conditions must be intensified. Hence, the need for higher pressure, higher temperature steam in the later portion of the dryer line.

Although the driest portion of the web receives the greatest magnitude of thermal energy, the return from such expenditure of energy in terms of moisture removed diminishes exponentially toward the dry end of the dryer line. Consequently, upon reaching the critical moisture content, the web drying rate thereafter is described as "falling."

In summary then, the web enters the dryer line at approximately 160% to 170% moisture content, experiences constant rate drying in terms of moisture removal per unit of time until reaching the critical moisture content in the order of 35% to 45% and is completed at a falling drying rate.

Two of the several factors affecting the magnitude of critical moisture content are the intensity of constant rate drying and the pulp stock drainage rate.

Drying intensity describes the magnitude of the thermodynamic drive in terms of water mass removed per unit of time. Under more intense thermodynamic conditions, water is removed more rapidly but consequently arrives at a greater critical moisture content. Under extreme conditions, a circumstance characterized as "case hardening," may be removed so rapidly from the web surface as to drive the web surface elements to such a low moisture content as to inhibit the transmission of sufficient heat to vaporize moisture retained at the web center.

Stock slowness is another factor affecting critical moisture content. The term slowness describes the time required for given quantity of water to drain from a stock sample. The same characteristic is more generally termed as drainage rate. Although raw pulp has a substantial drainage rate, the characteristic of slowness is further developed or increased as a consequence of refining which is applied for the primary purpose of web strength development. Relative to drying, it has been found that stock slowness affects the magnitude of critical moisture content in the relation that a slower stock will reach a lower characteristic critical moisture content, all other factors remaining constant.

It may be concluded from the foregoing that for a given stock (slowness) laid to a given thickness (basis weight) on a given papermachine (number and configuration of drying cylinders) there is an optimum drying rate to most efficiently utilize available steam in arriving at a target end moisture content. Such optimum conditions may be tailored to consume the least amount of steam for a given production rate or to elicit the greatest possible product (machine speed) from the magnitude of steam energy available. In either case, for a given stock and web thickness on a given machine, there is an optimum production efficiency in terms of paper production quantity per unit of steam or heat energy consumed.

Although most of the foregoing theoretical or conceptual precepts are well known to the prior art of papermaking, the specific application of these precepts to a particular papermachine, running a particular but variable pulp requires considerably more finesse than science.

Normally, papermachine dryer control is a fixed, pressure differential regulation between the several dryer sections. If the machine is dryer-limited, i.e. set for exploiting all the steam available from generation sources, control is simply a matter of speed regulation. The machine speed limit is set against the moisture content of the web at the reel. U.S. Pat. No. 3,801,426 includes a representative disclosure of this type of control.

If the machine is not dryer limited so that the machine speed is determined by other factors and sufficient excess steam capacity is available to dry as much web as the machine will otherwise produce, control takes the form of active pressure regulation. U.S. Pat. No. 3,930,934 is a representative disclosure wherein appropriate sensor signals of web basis weight, moisture and temperature characteristics are processed by automatic data processing equipment with historically developed computer programs for the purpose of actively regulating the steam supply pressure (and hence, the dryer, temperatures). Abundantly available steam energy allows the web to follow a consequential drying rate trajectory which may or may not be the most energy efficient trajectory for the particular stock furnish from which the web is laid.

It is an objective of the present invention, therefore, to teach a papermachine dryer control method and apparatus whereby the pulp characteristic of drainage rate is a pivotal control variable in the determination of an optimum, energy efficient paper web drying trajectory.

Another objective of the present invention is to provide a feed-forward type of control system for active regulation of steam pressure differential regulation between the several dryer sections of a papermachine.

Another objective of the present invention is to teach a method for drying a particular paper web to the lowest possible moisture content in the constant rate phase thereby minimizing steam requirements for the falling rate phase.

Another objective of the present invention is to teach a method of deriving the greatest possible production rate from a given papermachine running a particular stock with dryer limited steam capacity.

SUMMARY OF THE INVENTION

These and other objectives of the invention are accomplished by an analytical method of determining the lowest or characteristic critical moisture content of a particular pulp stock. From the characteristic critical moisture content is determined the specific identity of the particular dryer whereat the web drying rate trajectory changes from a constant or linear drying rate to a falling or exponential drying rate. Definitively, that drying trajectory which includes the lowest critical moisture content at the earliest possible amount or position along the dryer line is the most energy-efficient trajectory for the subject stock, basis weight, and papermachine.

With knowledge of the optimum drying rate trajectory, it is possible to determine the temperature differentials between the steam supplied to the drying cylinders and the web which are required to achieve the desired rate trajectory. Finally, steam pressure differentials across the several machine dryer sections are actively regulated to produce the desired temperature differentials.

Also taught by the present invention is a method for monitoring the magnitude of condensate accumulation within the dryer cylinders and limiting the operation of the primary, drying rate trajectory control.

BRIEF DESCRIPTION OF THE DRAWING

Relative to the several figures of the drawing wherein like or similar reference characters designate like or similar elements.

DESCRIPTION OF THE PREFERRED EMBODIMENTS

Figure 1:
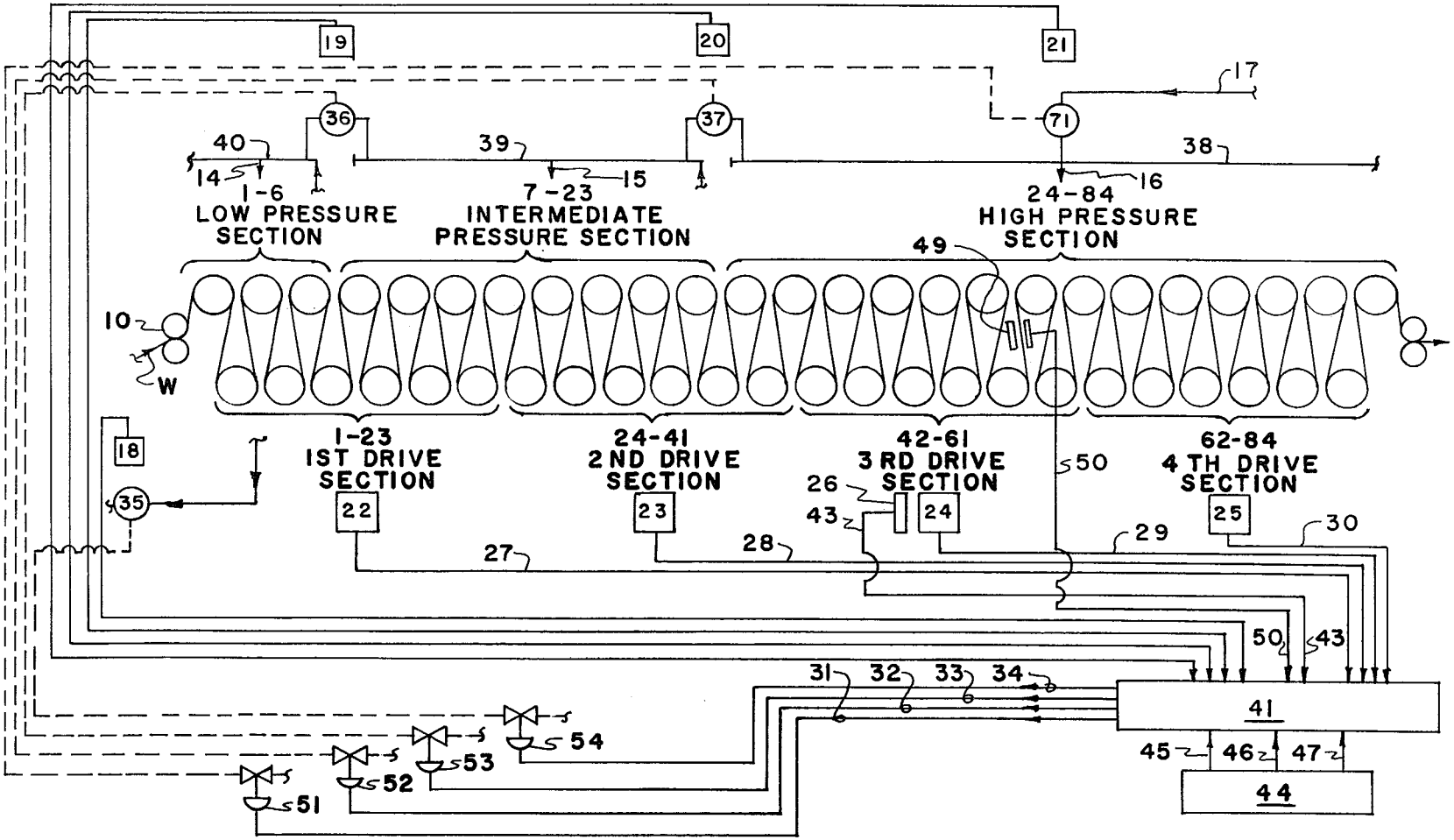
FIG. 1 is a flow schematic of a papermachine dryer line.

The line schematic of FIG. 1 represents a typical fourdrinier papermachine having 4 dryer drive sections with 23 dryer cylinders in the first drive section relative to the indicated traveling route of the web W. 18 dryers are provided in the second drive section, 20 dryers in the third drive section and 23 dryers in the fourth drive section. Each drive section has a respective, controlled ratio, speed differential drive unit 22, 23, 24 and 25 for the purpose of accommodating web length shrinkage as drying progresses.

Figure 2:
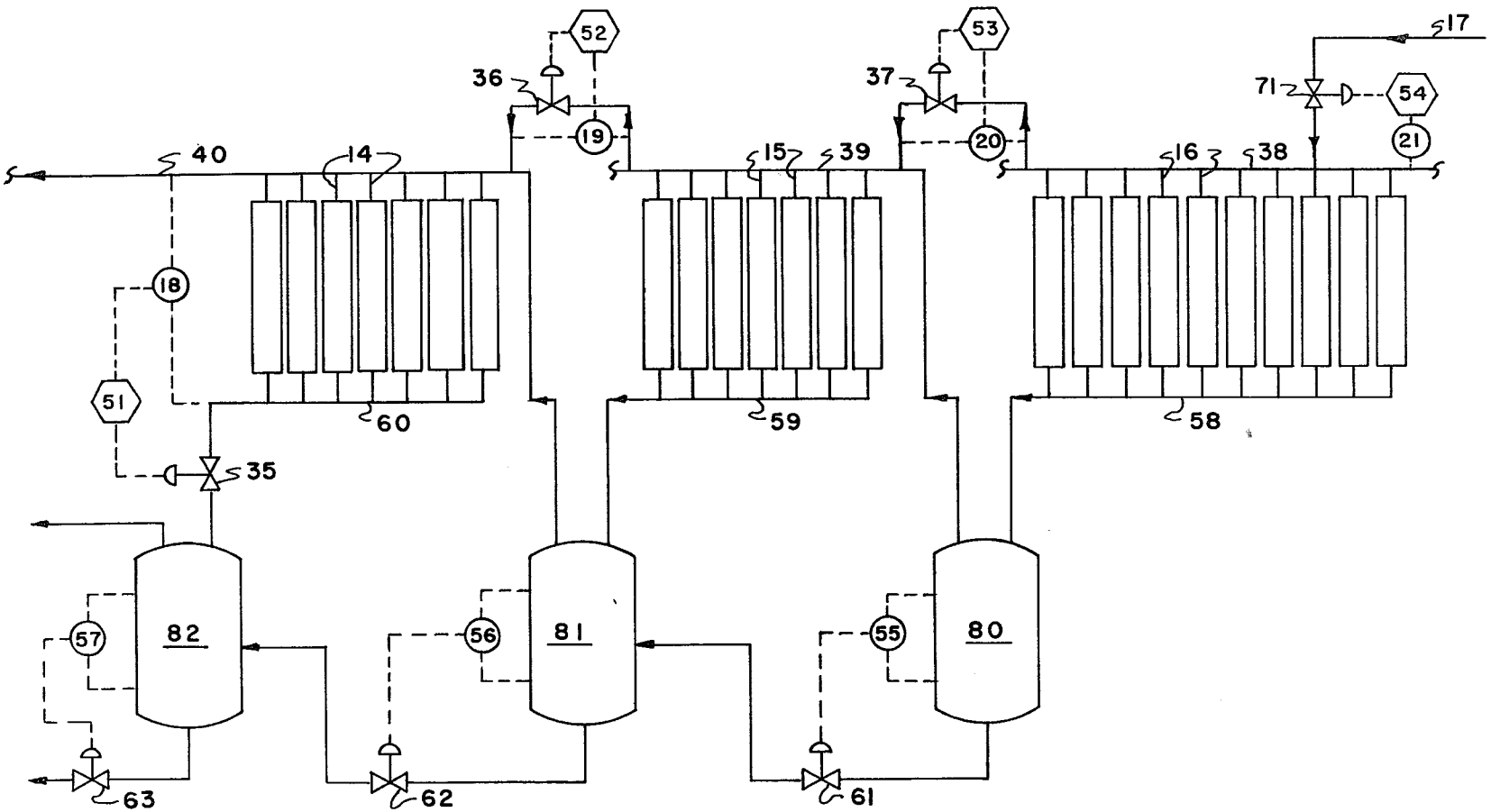
FIG. 2 is a detailed schematic of the steam flow partially represented by FIG. 1.

The schematic of FIG. 2 is provided to illustrate the steam flow and pressure control system in greater detail and in isolation from the condition sensor and control circuitry of FIG. 1.

Conduit 17 delivers high pressure mill steam to the dryer system through a flow throttling valve 71 and into high pressure header 38 from which a plurality of connector conduits 16 distribute steam to the several dryer cylinders of the high pressure dryer section. In this example, the high pressure drying section comprises the cylinders of the second, third and fourth drive sections (numerically, dryers 24 through 84). In the mathematical nomenclature to follow, these high pressure drying cylinders shall be identified collectively by the character $\Delta N_h$.

After passage through the high pressure dryers, the fluid steam is carried by a condensate header 58 to a separator 80 where the liquid condensate is separated from the residual vapor. Steam from the separator 80 is next directed to the intermediate pressure header 39 for distribution to dryers 7 through 23 via the plurality of connector conduits 15. These intermediate pressure drying cylinders are collectively characterized in the following mathematics as $\Delta N_i$.

Intermediate pressure condensate header 59 carries the further cooled flow stream to separator 81 for additional condensate separation. Remaining steam is drawn from separator 81 for distribution by low pressure header 40 to dryer numbers 1 through 6 of the low pressure drying section via a plurality of connector conduits 14 and, finally, by condensate header 60, to separator 82. The mathematical characterization of the low pressure drying cylinders is $\Delta N_l$.

The magnitude of heat energy transferred to each of the dryer pressure sections is controlled by means of pressure differential valves 35, 36 and 37. Each valve by-passes a sufficient quantity of steam from the higher pressure header directly into the lower pressure header to maintain the desired pressure differential between the two. Since the steam temperature is a function of the steam pressure, the collective temperature of the dryer cylinders of a respective pressure section of the system is thereby controlled.

Valve controllers 51, 52, 53 and 54, provide motive power to valves 35, 36, 37 and 71, respectively. These controllers are well known electro-mechanical devices which compare an actual pressure or pressure differential condition to a reference or set-point condition and emit an appropriate power signal such as a pneumatic pressure value to a direct control means such as valves 35, 36, 37 and 71. The set-point condition is dictated by externally provided signals 31, 32, 33 and 34 such as may be issued from a computer 41 source.

Transmitters 18, 19, 20 and 21 serve the controllers 51, 52, 53 and 54 by comparing the actual pressures in the respective steam sections and emitting an appropriate signal proportional to the differential result to the controller for comparison to the assigned set-point.

For the purpose of energy conservation, separators 80, 81 and 82 are connected in series to recover the heat value of higher pressure condensate as lower pressure vapor. Liquid level controllers 55, 56 and 57 assure a minimum and maximum condensate reservoir in each of the separators with an active control link to flow throttling valves 61, 62 and 63, respectively.

In addition to the steam flow control system, drive torque measurement signals 27, 28, 29 and 30 are derived from each of the mechanical drive differential units 22, 23, 24 and 25, respectively. A tachometer transmitter 26 is also connected to the third section differential 24 for emission of speed signals 43.

Photosensor 49 disposed at a convenient location along the web route provides a signal 50 in the event of a paper break.

The aforedescribed machinery and equipment is a representative operational vehicle for the present invention which further comprises automatic data processing equipment 41 and input console 42.

Other equipment useful to the practice of the present invention but not shown in the drawing may include pulp drainage and web moisture content measuring devices. U.S. Pat. No. 3,846,231 describes a device for automatically sampling a pulp flow stream and emitting an electrical signal proportional to the pulp drainage rate.

Practice of the present invention requires the preliminary determination of certain relationships characteristic of the particular papermachine to which it is applied, and the type of pulp stock from which a particular basis weight web is formed. Having characterized these relationships, a series of calculations based on the relationships and the drainage rate of a particular increment of stock flowing to the papermachine are performed for the purpose of determining the optimum machine operating condition set-points. If maintenance of optimum condensate inventory within the subject papermachine drying cylinders is a suspected problem incident to optimum set-point operation, a trial-and-error condensate monitoring program is disclosed for finding a set of machine conditions most proximate of the optimum conditions that is also compatible with an optimum condensate inventory maintenance.

To facilitate organization and clarity of disclosure, the following outline has been prepared. The text hereafter will generally follow this outline:

I. Characterize Pulp Type vs Papermachine
  A. Operating papermachine data
    1. speed
    2. $\Delta P$ settings
    3. MD web moisture profile
  B. Approximate critical moisture content $M_c$ (graphic solution)
  C. Calculate $\overline{\Delta T}$ (Equation 2)
  D. Characterize $M_o$
    1. inferred as a function of the difference between raw stock and machine chest stock drainage rate (Equation 3), or
    2. direct measurement
  E. Adjust papermachine for optimum operating conditions with at least 2 machine chest stock drainage rates
    1. maximize speed
    2. adjust $\Delta P_h$ and $\Delta P_i$
    3. maintain constant $M_f$
    4. note machine chest stock drainage rate (SN)
  F. Calculate ${}_cM_c$ and ${}_cN_c$ for respective 2 operating conditions and machine chest drainage rate (simultaneous solution of Equations 4 and 5)
  G. Characterize ${}_cM_c$ as a function of SN (Equation 6)

II. Calculate $\Delta P$ Set-Point for Specific Stock Flow Increment
  A. Measure stock drainage rate (SN)
  B. Determine ${}_cM_c$ from SN (Eq. 6)
  C. Calculate ${}_c\underline{N_c}$ (Eq. 7)
  D. Calculate $\overline{\Delta T}$ (Eq. 8)
  E. Calculate $\Delta T_h$ (Eq. 10)
  F. Calculate $\Delta T_i$ and $\Delta T_h$ (Eq. 13 & 14)
  G. Calculate $P_l$ (Eq. 15)
  H. Calculate $P_i$ (Eq. 15)
  I. Calculate $\Delta P_l$ (Eq. 16)—Set-Point
  J. Calculate $\Delta P_i$ (Eq. 17)—Set-Point III Condensate Inventory Maintenance
  A. Monitor dryer torque
  B. Step-changes in $\Delta P$ Step-Points
  C. Repeat A & B

I. Characterize Pulp Type vs Papermachine

As the first order in the overall method sequence described herein, a relationship must be established between the pulp drainage characteristics and the lowest possible critical moisture content of a web formed from such pulp. Such lowest possible critical moisture content shall be characterized as the characteristic critical moisture content, ${}_cM_c$.

Establishment of this pivotal relationship between ${}_cM_c$ and pulp drainage rate will, in the first instance, relate to a specific papermachine and web basis weight. In otherwords, it is assumed that the papermachine to which the present invention is applied is in actual production of a particular paper product. In all probability therefore, the machine will be operating with at least a commercially profitable degree of efficiency although suspected of less than optimum efficiency.

Under the foregoing circumstances, operating history of the machine will provide such data as dryer steam pressures and differentials between the several dryer sections of the machine, the steam flow rate, the final or reel moisture content, $M_f$, of the web as it emerges from the last dryer section (usually a specified constant) and the machine speed, S, which is usually the maximum speed at which the given web is dried to the specified final moisture content, $M_f$, with the historical dryer steam pressure differential settings.

These parameters will relatively change from time to time due to uncontrolled changes in the stock drainage characteristics. For example, if the steam flow (pressure differentials through the several pressure sections) is held constant, the machine web speed must be reduced to maintain a contant final moisture content $M_f$ with a relatively slower draining pulp. Generally, such speed changes are effected automatically by means such as described by U.S. Pat. No. 3,801,426. Another technique of automatic speed regulation is disclosed by U.S. Pat. No. 3,649,444 to J. M. Futch, Jr. for the purpose of basis weight and final moisture control. The present invention has particular value and utility to the Futch papermachine control technique.

If it were possible to directly measure the moisture content of the web at several points along the dryer line, it would be a simple matter to correlate the drainage rate of the stock furnished to the machine with a corresponding set of MD (machine direction) moisture profile data. However, when a machine is operating smoothly, the web within the dryer section is manually inaccessible. Consequently, special procedures must be implemented to acquire such correlative data. The objective of such special procedures is to establish a method for inferentially determining the characteristic critical moisture content, ${}_cM_c$, of a particular portion of web production so that pulp drainage rate data may be coordinated therewith.

As a first step to such special procedures, reliance is based upon an opportune interruption of the running web continuity i.e., a paper break. Such an event provides an ideal opportunity to manually measure the moisture content of the web at numerous positions along the length thereof. If taken immediately after the web break, such measurements provide an accurate MD moisture profile of the web in relation to the position each measurement point had along the dryer line at the moment of break.

At least five web moisture content data points are necessary:

(1) at a point upon entry into the steam drying line, $M_o$;
(2) a first point believed to be within the constant drying rate segment of the high pressure section of the drying line, $M_1$;
(3) a second point believed to be within the constant drying rate segment of the high pressure section of the drying line, $M_2$;
(4) a point believed to be within the early falling drying rate segment of the drying line, $M_3$; and
(5) a point upon emergence from the drying line, $M_f$.

Figure 3:
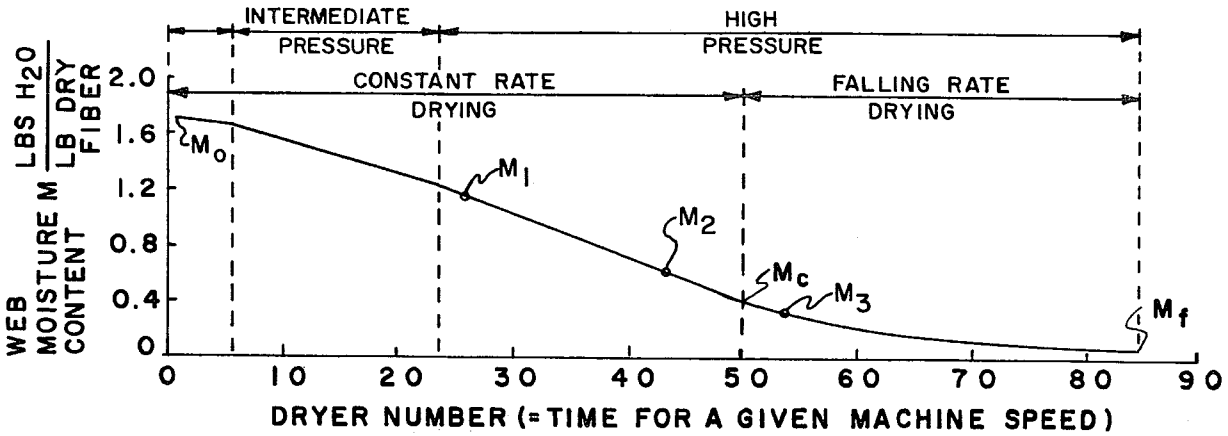
FIG. 3 is a web moisture content versus dryer cylinder number plot of a typical web drying trajectory.

If numerous web moisture content data points are taken and plotted against dryer line position such as by dryer cylinder order, the classical drying profile curve of FIG. 3 will be developed. The critical moisture content point $M_c$ occurs where the plot departs from a straight line locus and begins an exponential locus. It will be noted from FIG. 3 that the moisture profile through the constant drying rate interim actually comprises three distinct constant rate segments respective to the three steam pressure sections of the dryer line.

Figure 4:
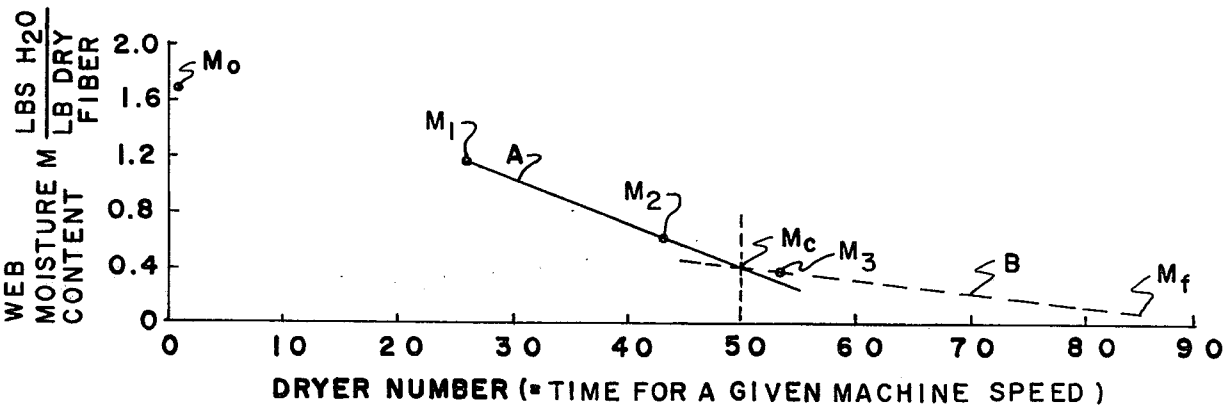
FIG. 4 graphically represents a simplified linear approximation of a web drying trajectory.

If data points $M_1$, $M_2$, $M_3$ and $M_f$ are plotted, a graph such as FIG. 4 is developed which provides a reasonable approximation of the value and location of the critical moisture content point, $M_c$. This point occurs at the intersection of straight lines A and B extrapolated, respectively, through the constant and falling drying rate data points. Since in this solution it is only necessary to fix the location of the constant rate locus of the final or high pressure section (line A) to identify the coordinates of the $M_c$ point, the actual slope of low and intermediate pressure section segments of the full constant rate profile are irrelevant. Accordingly, it is only necessary to obtain measured data points for the final segment of the constant rate profile.

This graphic approximation of $M_c$ from machine data will be specific to a particular machine speed. In other words, the FIG. 3 or 4 plotted drying profile will relate, in terms of $M_c$ value and location, only to that speed the machine was operating at the time the moisture data was generated, e.g. when the web broke. This set of data and the corresponding machine speed may be mathematically correlated by the constant drying rate equation:

$$S = \frac{h_f A}{\lambda} \cdot l \cdot \left( \frac{N_c \, \overline{\Delta T}}{M_o - M_c} \right) \qquad \text{(Eq. 1)}$$

where:

S = machine speed, fph;
$h_f$ = total heat transfer coefficient, steam to web, BTU/hr.ft.$^2$.°F.;
$\lambda$ = latent heat of evaporation at web surface temperature, BTU/lb.;
A = area for heat transfer evaporation, ft.$^2$/lb. fiber;
l = web path length between corresponding points on successive dryers, ft.;
$N_c$ = numerical identity of dryer at which the critical moisture value, $M_c$, is reached;
$\overline{\Delta T}$ = average temperature differential between steam and web evaporation surface along constant drying rate section from $M_o$ to $M_c$, °F.;
$M_o$ = moisture content of web upon entry into the dryer section of papermachine lb. $H_2O$/lb. dry fiber; and
$M_c$ = critical moisture content of web at which the web drying rate ceases to be constant and starts to diminish exponentially, lb. $H_2O$/lb. dry fiber.

Parameters S, and $M_o$ are directly measured as explained above. Parameters $M_c$ and $N_c$ are graphically determined from the FIG. 3 or 4 plot of directly measured data. Parameters $h_f$, $\lambda$, A, and l, collectively, are heat transfer functions which are relatively constant throughout the machine operating range and need no value determination for reasons subsequently to become apparent.

The $\overline{\Delta T}$ parameter of Equation 1 is determined from the dryer steam pressure data related to the foregoing papermachine speed and web moisture measurements. Such dryer steam pressure data may be correlated to temperature differentials between the steam in a particular pressure section and the web temperature by experimentally developed correlations normally provided by dryer cylinder manufacturers such as the graph of FIG. 5 published by The Johnson Corporation of Three Rivers, Mich.

From such information, $\overline{\Delta T}$ is determined by the apportionment relation:

$$\overline{\Delta T} = \frac{\Delta T_l \Delta N_l + \Delta T_i \Delta N_i + \Delta T_h (N_c - \Delta N_l - \Delta N_i)}{N_c} \quad \text{(Eq. 2)}$$

where:

subscript l relates to the low steam pressure dryer section;

subscript i relates to the intermediate steam pressure dryer section; and

Subscript i relates to the high steam pressure dryer section.

The foregoing development teaches one technique and analysis for correlating papermachine speed to the moisture content of the web at specific points along the constant drying rate trajectory. As a next step toward the objective of correlating pulp drainage rate to the characteristic critical moisture content, it is necessary to develop a technique for inferring the initial moisture content of the web $M_o$ independently of the previous determination which was a direct measurement taken at a fortuitous opportunity. Relative to FIG. 1, $M_o$ will be the moisture content of the web W as it emerges from the final wet pressing nip 10 and prior to contact with the first drying cylinder.

One successful approach to a convenient $M_o$ inference has been derived from the difference between the raw stock pulp drainage rate and that of the machine chest. This inferred relationship is predicated on the observation that for a web of given basis weight, the slowness of a pulp (drainage rate in terms of filtration resistance measured in time units of seconds) developed across paper mill refiners considered conjunctively with the raw stock slowness, defines the papermachine speed with reasonable accuracy. A notable limitation on this observation is that a raw stock slowness greater than a threshold value dictates a reduced papermachine speed that is independent of the refiner developed slowness. Nevertheless, within normal limits of raw stock slowness, refiner developed slowness (difference, ΔS, between machine chest slowness, SN, and raw stock slowness, RS) is representative of fourdrinier and press filtration resistance and, hence, the initial moisture content of the web, $M_o$, entering the steam dryers. For one particular paper grade (42 lb. linerboard) from pulp having a raw stock Westvaco slowness of less than 20 seconds laid on a particular papermachine wherein $M_o$ was approximately 170% dry basis moisture content, the arithmetic expression:

$$M_o = 1.613 + 0.0167 \cdot \Delta S \quad \text{(Eq. 3)}$$

where:

ΔS = SN-RS seconds, Williams Slowness was used to infer $M_o$ from the refiner development of slowness.

Inferred values of $M_o$ are necessary only if direct measurements are unavailable as is normally the case. Some papermachines, however, may be equipped with web moisture sensing instrumentation at the essential point in the web route between the last press nip 10 and the first steam drying cylinder. Such direct measurement would surely be superior to the above inferential technique.

Using the foregoing analytical tools, values and measurements, it is now possible to derive the web critical moisture content $M_c$ and its corresponding dryer cylinder location for any machine speed within the historically normal operating range. First, the constant drying rate speed and moisture content relationship of Equation 1 is used to ratio the measured operating parameters of the reference condition to known parameters of a different speed and/or initial moisture condition by the relation:

$$\frac{S_{new}}{S_{ref}} = \frac{\left[\dfrac{N_c \cdot \overline{\Delta T}}{M_o - M_c}\right]_{new}}{\left[\dfrac{N_c \cdot \overline{\Delta T}}{M_o - M_c}\right]_{ref}} \quad \text{(Eq. 4)}$$

Under the "new" operating conditions, speed, $S_{new}$, is known by direct measurement. $\overline{\Delta T}_{new}$ may be determined in terms of $N_{cnew}$ from the directly measured new condition dryer pressures using the equipment characteristic curve of FIG. 5 to conclude the $\overline{\Delta T}$ of the respective dryer sections and the apportionment relationship of Equation 2. This will leave the parameters $M_{cnew}$ and $N_{cnew}$ as yet remaining unknown. Determination of these unknowns is won from simultaneous solution of the equation 4 ratio relationship with the falling drying rate expression:

$$\frac{N_c \, \overline{\Delta T}}{(N - N_c)\, \Delta T_c} = \frac{0.8214\,(M_o - M_c)}{(M_c - 0.19)\ln\left[\dfrac{(1.169 - M_f)(M_c - 0.0156)}{(M_f - 0.0156)(1.169 - M_c)}\right]} \quad \text{(Eq. 5)}$$

where:

all values relate to the "new" condition and, $M_o$ is either measured or inferred from the Equation 3 relationship;

$\overline{\Delta T}$ is expressed in terms of $N_c$ with the apportionment relation of Equation 2;

$M_f$ is directly measured; and $\Delta T_c$ is the steam minus web temperature difference at the critical dryer $N_c$ which is unknown under the "new" condition.

Although $\Delta T_c$ is analytically indeterminate, certain incidents known about the parameter permit a reasonable approximation for rapid trial and error solution. If, from the reference conditions, the critical dryer number $N_c$ is found to fall comfortably within the high steam pressure dryer section, it is normally reasonable to assume that the "new" condition critical dryer will be located in that pressure section also. Consequently, $\Delta T_c$ may be taken from FIG. 5 as that value which corresponds with the high pressure steam value.

Since a simultaneous solution of Equations 4 and 5 will yield the critical dryer number, $N_c$, and critical web moisture content, $M_c$, for any machine speed within the reasonable operating range, it is now possible to conveniently correlate a number of measured machine chest stock drainage rate values, SN, to critical moisture content values, $M_c$. It will be recalled, however, that the objective of this exercise is to correlate machine chest stock drainage, SN, to the web characteristic critical moisture content ${}_cM_c$. For this purpose it is necessary to manipulate the steam pressures in the low and intermediate pressure sections while noting the responsive effect on the papermachine speed and final moisture content, $M_f$, of the product.

Because of the tendency of papermakers to dry a web excessively fast through the constant drying rate interim, such a condition may represent a first assumption for pressure differential value changes, $\Delta P_h$ and $\Delta P_i$. Accordingly, the pressure differentials $\Delta P_h$ and $\Delta P_i$ between the high and intermediate pressure sections and between the intermediate and low pressure sections, respectively, are increased above the historical operating values to reduce the steam temperature in the low and intermediate pressure sections and therefore reduce these segments of the constant drying rate. If the first assumption is correct, the machine speed may be increased while the final web moisture content $M_f$ is maintained.

This technique of incremental changes in the pressure differentials is repeated until no further speed increase is obtainable without an increase in $M_f$. It may therefore be concluded that the machine is operating at the optimum constant drying rate for the pulp furnished and the consequent critical moisture content is the lowest obtainable critical moisture content, ${}_cM_c$. If the subject papermachine is controlled by a system such as disclosed by the 3,649,444 Futch patent, the speed changes will occur automatically with a constant or set-point basis weight and final moisture content, $M_f$.

It should be understood that if the high and intermediate pressure differentials are increased excessively, the resulting critical moisture value will be the same, characteristic value, nevertheless. However, that characteristic value will be reached, in the constant rate trajectory, at a later time along the dryer line. Consequently, the trajectory so defined will not be the optimum trajectory. This circumstance will be manifested by a speed reduction if the $M_f$ is to be maintained, or, alternatively, by an $M_f$ increase if speed is maintained, all other variables remaining constant.

When it is known that the subject papermachine is operating at optimum efficiency which includes a constant drying rate trajectory passing through the lowest critical moisture content ${}_cM_c$ at the earliest moment ${}_cN_c$ with a pulp of known drainage characteristics, the necessary data for the simultaneous solution of Equations 4 and 5 is recorded and values for $M_{cnew}$ (${}_cM_c$) and $N_{cnew}$ (${}_cN_c$) derived.

Practice of the foregoing pressure stepping procedure for determination of optimum drying rates is performed for at least two pulp drainage rate values. Preferably, the chosen drainage rate values are of opposite extremes within the normal range of pulp furnish variation.

Figure 6:
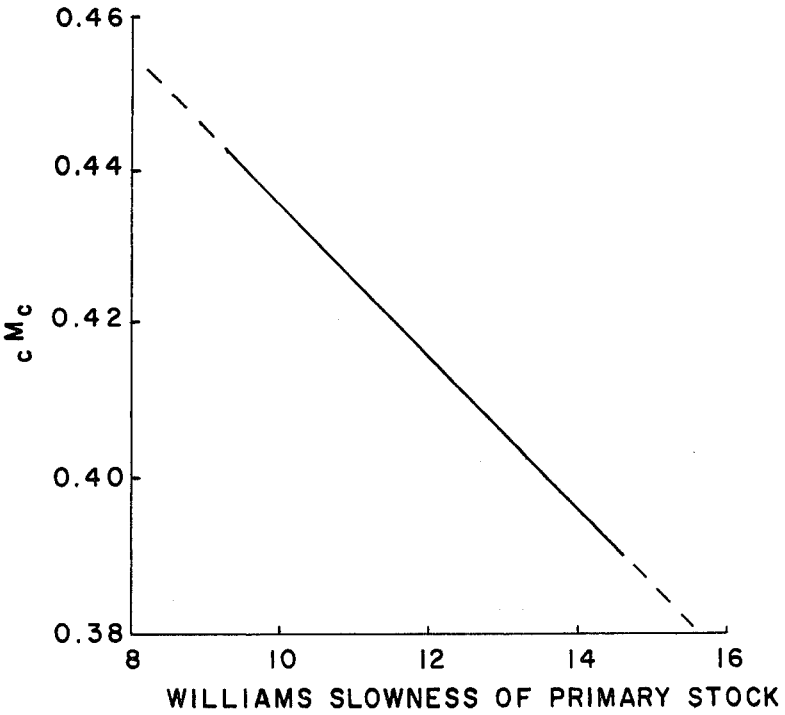
FIG. 6 is a graphic representation of a determined correlation between characteristic critical moisture content of a web versus the drainage rate of pulp stock from which the web was formed.

Such drainage rate values, SN, may then be coordinated to corresponding ${}_cM_c$ values by graphic means such as FIG. 6 or described by an equation such as:

$$ {}_cM_c = 0.535 - 0.01(SN) \qquad \text{(Eq. 6)} $$

where:

SN = drainage rate of stock in machine chest, Williams slowness scale, seconds; and ${}_cM_c$ = characteristic critical moisture content of web, lbs. $H_2O$/lb. dry fiber.

It will be understood that the function relationship between characteristic critical moisture content and pulp drainage rate shown by FIG. 6 and stated by Equation 6 is probably unique to the papermachine from which the developmental data was taken. For this reason, the foregoing explanation has been given to teach a technique by which those who would practice the present invention may characterize any papermachine with corresponding functional relationships.

Additional techniques for practicing the present invention follow from a deeper understanding of certain implications.

II. Calculate ΔP Set-Points

As a first objective of the present invention, the foregoing has taught a technique whereby a basic correlation between the pulp drainage rate and the characteristic critical moisture content may be established. Once established, this correlation may be utilized manually or in a feed-forward control scheme to automatically regulate the papermachine steam pressure in the several dryer sections to maintain the most efficient drying trajectory notwithstanding drainage rate variation in the pulp furnish. The primary independent variable to such an automatic control scheme may be signal 45 (FIG. 1) representative of the machine chest stock slowness. Values for those signals may be taken manually on a periodic schedule or automatically by an automatic drainage measurement device such as that disclosed by U.S. Pat. No. 3,846,231 which continuously transmits compatible signals corresponding to the momentary pulp drainage rate to an automatic data processing computer 41.

It will be recalled that both ${}_cM_c$ and ${}_cN_c$ were determined in a simultaneous solution of Equations 4 and 5. Consequently, using a relationship such as Equation 6 between ${}_cM_c$ and SN along with the relations specified by Equations 4 and 5, determines a relation between SN and ${}_cN_c$ or $\overline{{}_c\Delta T}$. However, it may be more convenient from the perspective of computer utilization to derive a direct relationship for critical dryer identity $N_c$ from the initially determined ${}_cM_c$. This solution procedure requires a relationship such as:

$$ N_c = 137.6 - 264.1({}_cM_c) + 154({}_cM_c)^2 \qquad \text{(Eq. 7)} $$

which, like the relationship of Equation 6, is unique to the particular papermachine from which the original data was taken but is adaptable in arithmetic form to any papermachine by the aforedescribed method.

Similarly, for the purpose of rate trajectory establishment, it is necessary to determine the lowest or characteristic average temperature differential $\overline{{}_c\Delta T}$ between the steam temperature and the web within the constant drying rate interim. Once again, solution may be drawn from either the basic Equation 4 or 5 relationships or an equation dependent on ${}_cM_c$ taking the form:

$$ \overline{{}_c\Delta T} = 204.4 - 218.2({}_cM_c) + 313({}_cM_c) \qquad \text{(Eq. 8)} $$

Next in the development of a complete dryer control scheme based upon the foregoing fundamental premises and conclusions is determination of the actual pressure differential settings for the papermachine as constructed. It will be recalled that on the subject papermachine only three pressure zones were available for separate temperature control. The low pressure zone may comprise, for example, the first 6 dryer cylinders ($\Delta N_l$), the intermediate pressure zone may comprise dryers 7 through 23 or, the next 17 dryers ($\Delta N_i$) whereas the high pressure zone may comprise dryers 24 through 84, or, the last 61 dryers ($\Delta N_h$).

Figure 5:
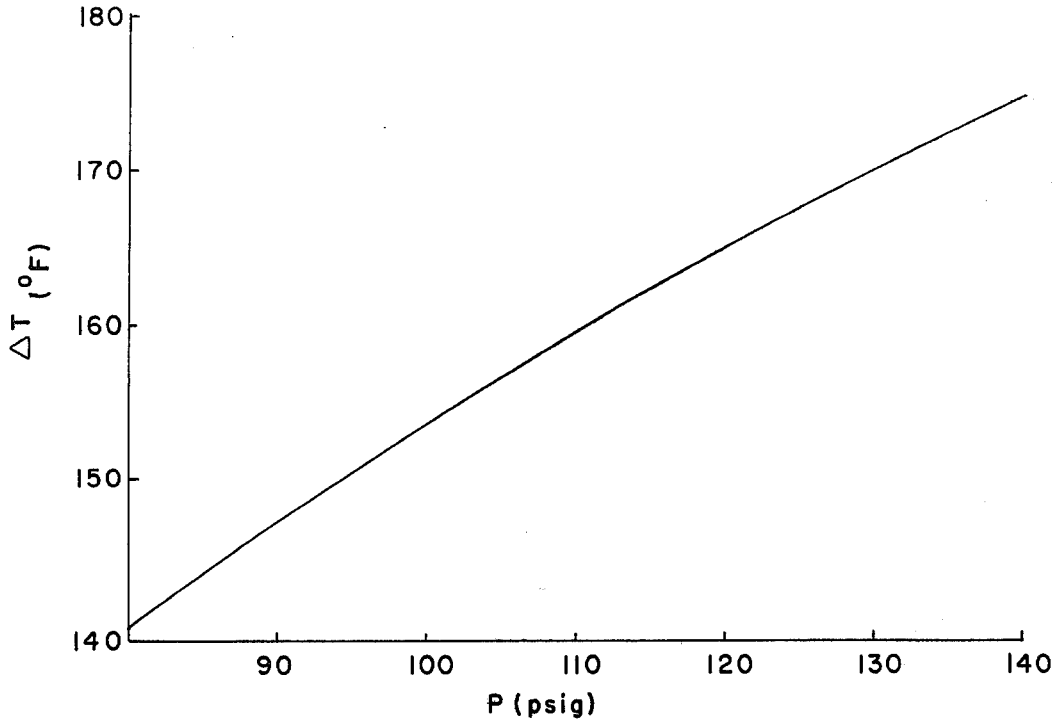
FIG. 5 is an equipment calibration curve describing the temperature differential between that of a web contacting a drying cylinder and the steam temperature therewithin versus the pressure of the supply steam.

The usual operating objective of most commercial papermachines is to produce as much product as steam drying capacity will permit. Accordingly, high pressure steam valve 71 (FIG. 2) is opened to admit the full pressure of mill supply line 17 unthrottled into the high pressure dryer header 38. A typical value of such pressure may be 130 psig which may be translated to a temperature differential $\Delta T_h$ between the steam temperature at this pressure and the web temperature by the equipment heat transfer characteristic curve of FIG. 5. The equation:

$$\Delta T_h = 75.125 + 0.9P_h - 0.0125P_h^2 \quad \text{(Eq. 9)}$$

correlates the stream pressure with the corresponding $\Delta T$ value for the particular equipment described by FIG. 5.

To obtain the proper temperature differential values for the intermediate and low steam pressure sections of the dryer line, the energy of the average constant drying rate temperature differential $\overline{{}_c\Delta T}$ calculated by Equation 8 is assigned the apportional definition:

$$\overline{{}_c\Delta T} = \frac{\Delta N_i \Delta T_i + \Delta N_l \Delta T_l + ({}_cN_c - \Delta N_l - \Delta N_i)\Delta T_h}{{}_cN_c} \quad \text{(Eq. 10)}$$

The Equation 10 relationship is combined with a prior art practice of setting temperature differentials between the three steam sections of the dryer line to conform with:

$$\Delta T_h - \Delta T_i = (\Delta T_l) - 2 \quad \text{(Eq. 11)}$$

Simultaneous solution of Equations 10 and 11 with parameters $\overline{{}_c\Delta T}$, $\Delta N_l$, $\Delta N_i$, $\Delta N_h$, ${}_cN_c$ and $\Delta T_h$ known, yields the relationships:

$$\Delta T_l = \frac{\overline{{}_c\Delta T}\ {}_cN_c - ({}_cN_c - 23)\Delta T_h - 17 - 8.5\,\Delta T_h}{14.5} \quad \text{(Eq. 12)}$$

$$\Delta T_i = \frac{1 + \Delta T_h + \Delta T_l}{2} \quad \text{(Eq. 13)}$$

Equations 10 and 11 have general applicability to machines with three dryer pressure sections. Similar equations may be derived for machines with differing numbers of dryer sections.

With the knowledge derived from Equations 12 and 13, the equipment heat transfer characteristics of FIG. 5 are again relied upon in the arithmetic form of:

$$P = -15.6 - 0.02565\Delta T + 0.00513\Delta T^2 \quad \text{(Eq. 14)}$$

to conclude the pressure values $P_l$ and $P_i$ in low and intermediate pressure sections.

Pressure differential control valve 37 between the high and intermediate pressure drying sections may now be set to the value:

$$\Delta P_h = P_h - P_i; \quad \text{(Eq. 15)}$$

Control valve 36 between the intermediate and high pressure drying sections is set to the value;

$$\Delta P_i = P_i - P_l; \text{ and,} \quad \text{(Eq. 16)}$$

Control valve 35 between the low pressure condensate header 60 and vapor separator 82 is set to a value $\Delta P_l$ which is greater than $\Delta P_i$.

It will be understood by those versed in the art of computerized machine control, that the development of values for $\Delta P_h$, $\Delta P_i$ and $\Delta P_l$ respective to a give pulp stock having the measured drainage characteristic SN represents a set-point determining subroutine which may be incorporated into any compatible machine control program such as U.S. Pat. No. 3,649,444. A summary of this subroutine is shown by the algorithm schematic of FIG. 7.

In the preferred embodiment of the invention, machine speed is independently regulated as a direct function of the web final moisture content, $M_f$, or of web basis weight by prior art techniques identified herein. The present $\Delta P$ control coordinately controls drying trajectory so as to permit the greatest possible production speed consistent with characteristics of the stock furnished and the final moisture content, $M_f$, required. This technique is preferred because of the superior control stability inherent from independent speed and $\Delta P$ set-point determinations. It will be apparent to those of skill in the art, however, that due to the interrelationship of machine speed and drying trajectory described by Equation 4, it is possible to expand the present $\Delta P$ set-point determination subroutine to include a direct speed set-point determination. In this case, the computer 41 memory may be charged with a relationship such as that of Equation 3 for operational determination of initial moisture content $M_o$ at the same calculation frequency as provided for ${}_cM_c$ determinations.

Speed set-point calculations by Equation 4 require knowledge of the initial web moisture content $M_o$. If measured directly by well known prior art instruments as previously explained, the signal 46 would represent the measured value. If $M_o$ is inferred, as by the Equation 3 relationship, signal 46 would represent the measured value of raw stock slowness RS. In either case, $M_o$ is determined at approximately the same operational frequency as necessary for the ${}_cM_c$ determination and used with the ${}_cM_c$, ${}_cN_c$ and $\overline{{}_c\Delta T}$ values to solve the equation:

$${}_cS = S_{ref} \cdot \frac{\left(\dfrac{{}_cN_c \cdot \overline{{}_c\Delta T}}{{}_cM_o - {}_cM_c}\right)}{\left(\dfrac{N_c - \overline{\Delta T}}{M_o - M_c}\right)_{ref}} \quad \text{(Eq. 17)}$$

${}_cS$ then becomes the machine speed set-point by which the actual machine speed is regulated.

An additional subroutine utility for on-line ${}_cM_o$ and ${}_cS$ determinations may be for requisite steam flow rate determinations. Since steam flow rate is a function of the machine speed, web basis weight and total moisture differential ($M_o - M_f$), only the additional parameter of basis weight is required for such a computational determination. This (basis weight) value may be added to the computer 41 data bank by manual signal 47 from the console 42 or directly from automatic basis weight sensory devices well known to the prior art.

III. Condensate Inventory Maintenance

Early in the explanation of the present invention it was asserted that the heat transfer conditions of the subject papermachine were relatively constant and analytical reliance was based on that premise. This is a conditional premise, however, and one of the primary factors affecting that premise is the magnitude of condensate retained in the respective dryer cylinders.

Papermachines of relatively recent design and construction are provided with positive condensate removal and control systems for maintenance of optimum condensate levels in the dryer cylinders. The siphon type of condensate removal systems of older machines, however, are insensitive to condition changes possibly resulting in the loss of optimum condensate reservoir quantities when the dryer load is suddenly reduced in the event of a web break or as the drying load approaches maximum capacity for the steam quantity supplied.

A generally accepted measurable indicator of condensate retention in the drying cylinders is the factor of drive torque. This parameter is sensed as a function of axial thrust force exerted by the output drive shaft from the drive differential of a respective mechanical drive section. For this application, the units of such torque measurements are normally stated as percentage values of the drive train rating. Such is the nature of torque signals 27, 28, 29 and 30 of the FIG. 1 schematic.

Due to the heat transfer significance of drying cylinder condensate quantities, the maintenance of drive torque limits has a significant bearing on the successful practice of the present invention.

Figure 8:
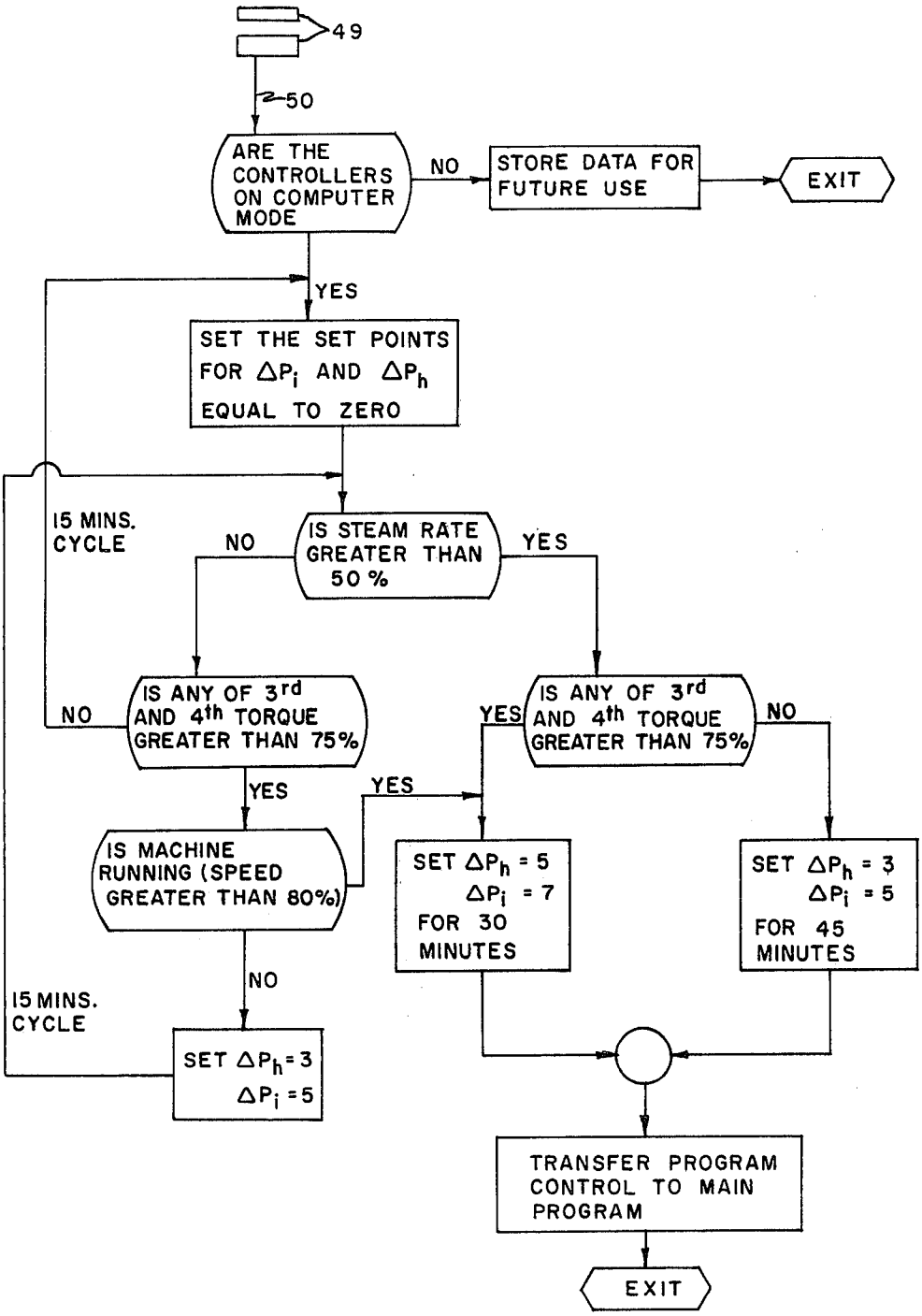
FIG. 8 is a algorithm schematic of another computer subroutine incorporating the invention.

A suitable torque responsive subroutine compatible with the present invention in the instance of a paper break is represented by the FIG. 8 algorithm. The primary subroutine objective is to maintain nominal operating conditions in the machine drying section notwithstanding an absence of drying load in the form of a wet web. Pursuant to this objective, dryer cylinder condensate inventory and temperature is sustained at a nominal level in readiness for resumption of web load. This program is initiated by the signal 50 (FIG. 1) from web photosensor 49. If the subject papermachine is under computer control when the paper breaks, receipt of photosensor signal 50 causes an immediate change in the pressure differential set-points $\Delta P_h$ and $\Delta P_i$ to zero. Next, the present steam flow rate is reviewed to determine if it exceeds a certain percentage (50%, for example) of the maximum flow rate, for the purpose of re-setting the $\Delta P_h$ and $\Delta P_i$ set-points to one of two predetermined conditions dependent on the torque and speed status of the third and fourth drive sections. If the predetermined steam percentage is exceeded and the third and fourth drive section torque exceed 75%, for example, the high and intermediate pressure differential values are set at 5 and 7 psi respectively, for a predetermined time interval e.g. 30 minutes. If the predetermined steam percentage is exceeded but the third and fourth drive section torque does not exceed 75%, the high and intermediate pressure differential values $\Delta P_h$ and $\Delta P_i$ are set at 3 and 5 psi for a slightly greater time interval such as 45 minutes.

In the event that the steam percentage is not exceeded and the third and fourth drive section torque is less than 75%, the $\Delta P_h = \Delta P_i = 0$ condition is maintained and the status reviewed periodically. If the steam percentage is not exceeded but the third and fourth drive section torque is greater than 75%, the machine speed is also considered. A suitable set-point speed value may be in the order of 80% of the maximum machine speed. If this set-point value is not exceeded, $\Delta P_h$ and $\Delta P_i$ are set at 3 and 5 psi, respectively, and the status periodically reviewed.

If the set-point speed value is exceeded as is also the limit torque value of the third and fourth device, the pressure differentials are set to the first case 5 and 7 psi values for 30 minutes.

Figure 7:
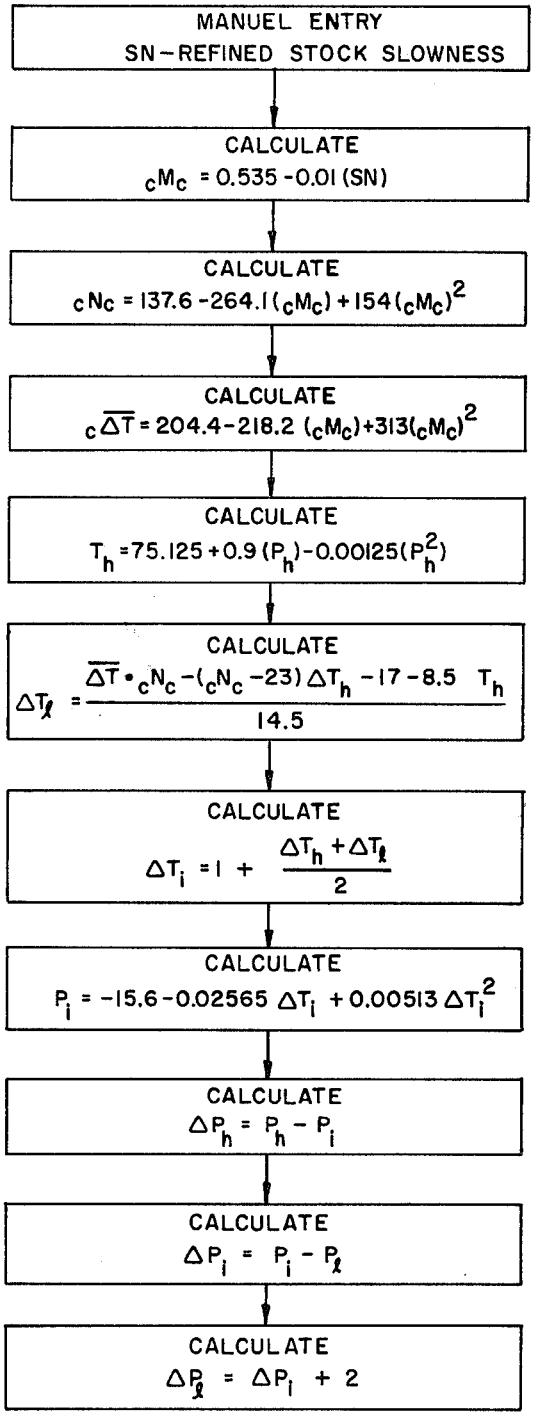
FIG. 7 is an algorithm schematic of a computer subroutine incorporating the invention.
Figure 9A:
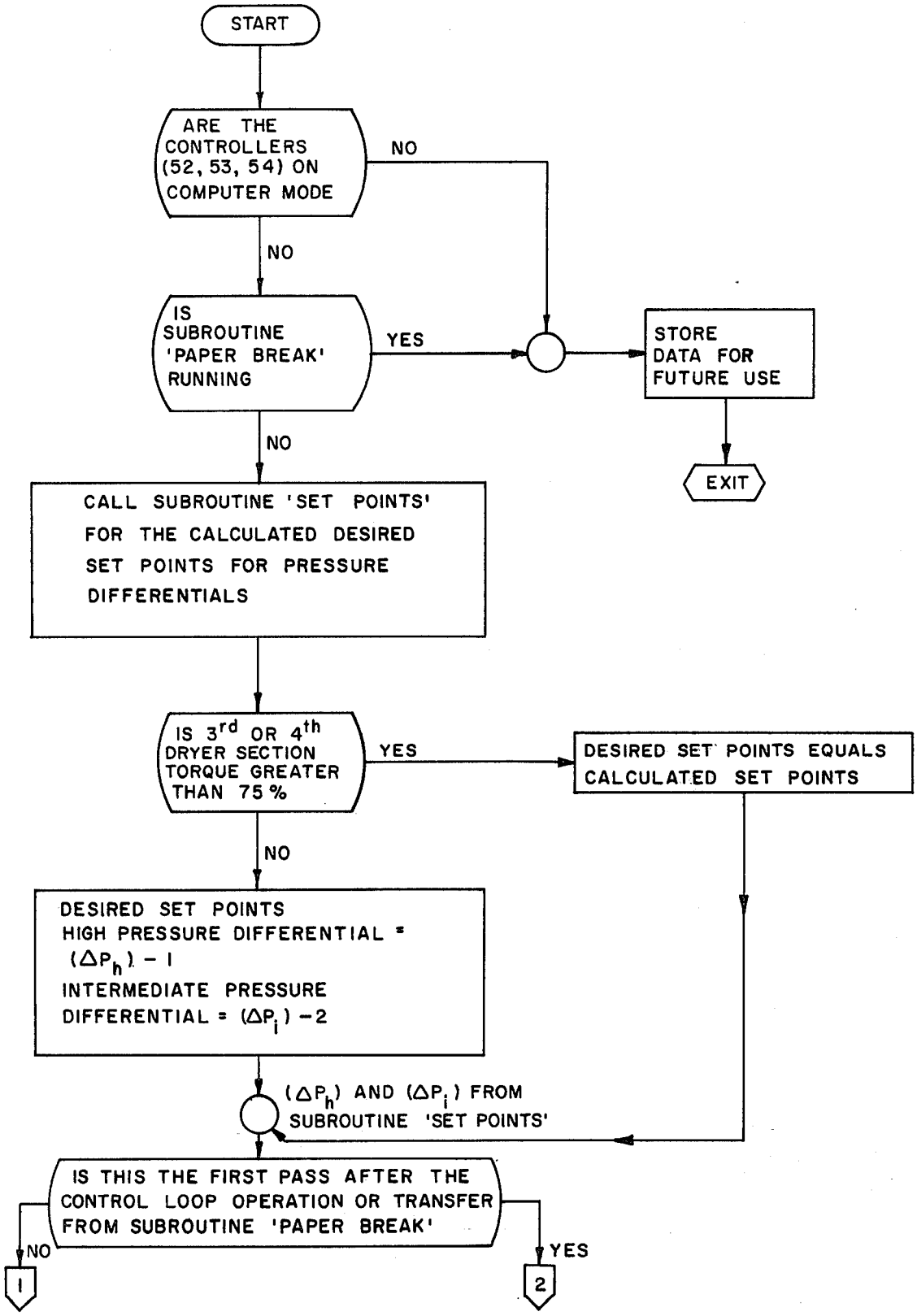
FIGS. 9A, 9B, and 9C are viewed collectively as a dryer pressure, torque and speed control program incorporating the present invention.
Figure 9B:
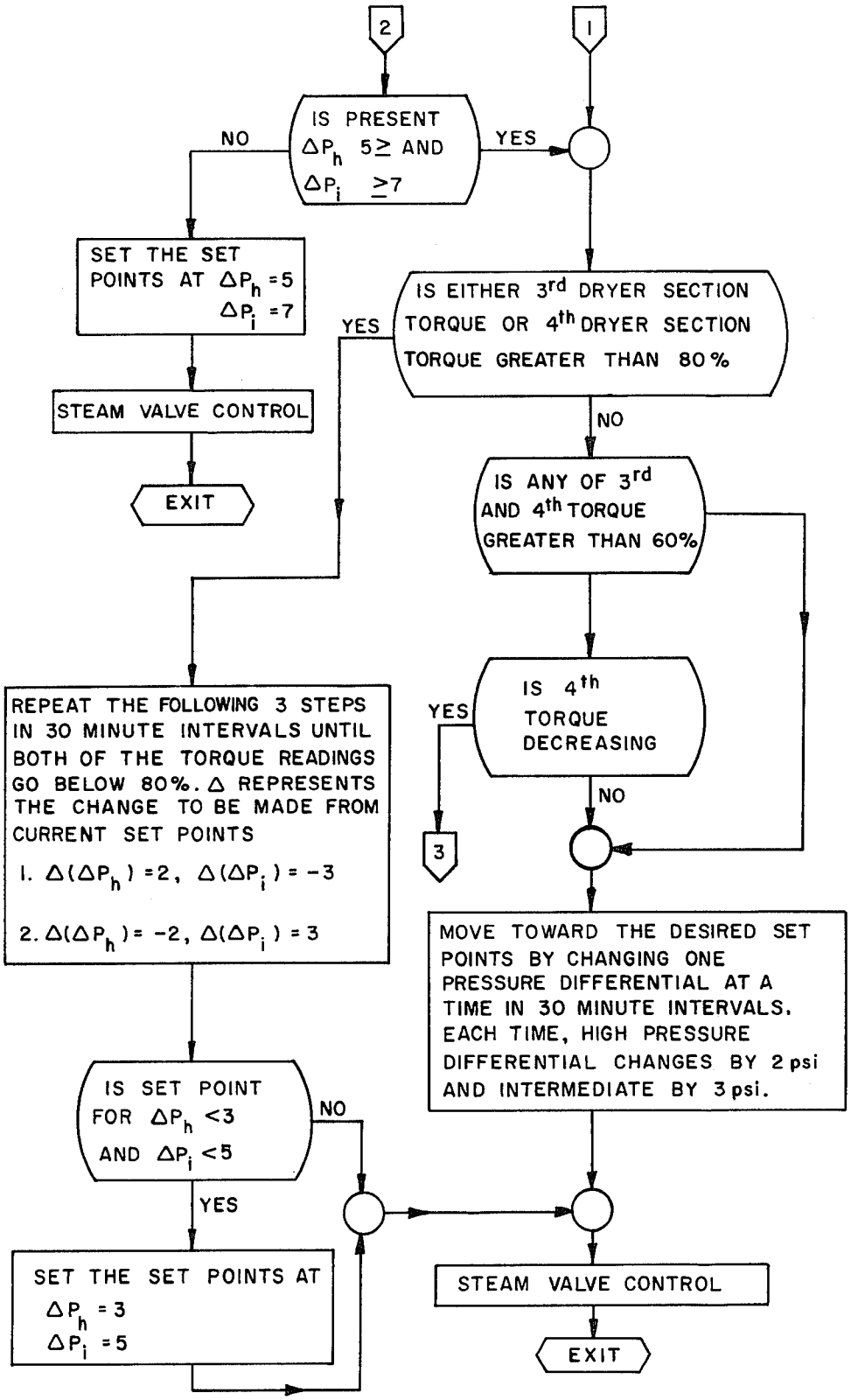
Figure 9C:
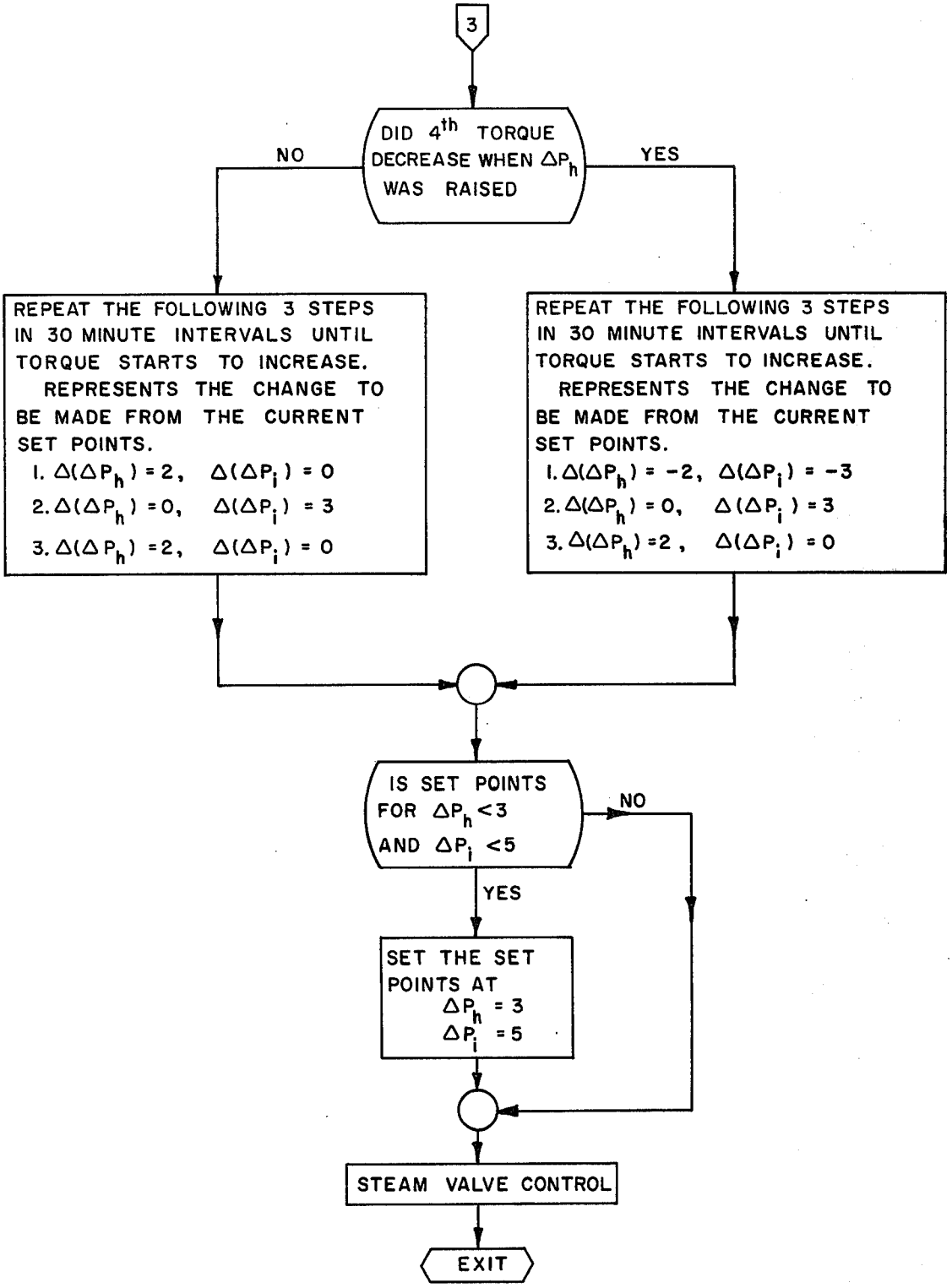

The computer algorithm of FIGS. 9A, 9B and 9C summarizes a dryer drive torque monitoring program that is responsive to the dryer pressure set-point determinations of the previous FIG. 7 program. This FIGS. 9A, 9B, 9C program is applicable to the normally productive operation of a papermachine for the purpose of dryer pressure control and for modifying the $\Delta P$ determination logic of FIG. 7 as dictated by dynamic changes in the condensate inventory.

Without recounting each logic step of FIG. 9A, B, C, which is self-explanatory, it is sufficient to state that from the drive torque measurements, the running program evaluates the condensate inventory and the dynamic trends thereof. If the inventory is more or less than that of a 75% torque result and growing away from the reference value, it is due to an inbalance between the condensation rate and condensate removal rate. Set-point changes are made in a manner to maintain torque at a given level. If the torque of both, third and fourth drive sections, is less than 60% and further, the fourth drive section torque is decreasing, the program initiates a series of trial-and-error changes in the $\Delta P$ set-points to fine a condensate balancing $\Delta P$ set most proximate of the calculated set.

It should be understood, however, that the specific numerical values given by the FIG. 9A, 9B, 9C program are not critical as to magnitude. These values are stated to illustrate relative proportionalities of changes from set-point values.

Having fully described my invention, many obvious modifications and variations thereof will occur to those of ordinary skill in the art. Specific parametric values and special case equations have been given to facilitate this teaching of my invention and are not to be interpreted as either limiting or restrictive of the invention scope which is defined by my following claims.

I claim:

1. A method of operating a papermachine having an evaporative web drying line including a plurality of heating fluid temperature sections comprising the steps of:

A. Deriving a functional relationship between a reasonable drainage rate range for a type of pulp stock laid on said papermachine to form a given basis weight web and the approximate lowest critical moisture content obtainable in said web at the substantially earliest position along said drying line;

B. Measuring the drainage rate of a particular flow increment of stock to said papermachine being of said type;

C. Determining from said drainage rate measurement and said functional relationship, a first physical representation of said lowest critical moisture content and a second physical representation corresponding to the point of earliest occurrence thereof along said drying line;

D. Forming a web on said papermachine of said basis weight from said stock flow increment;

E. Deriving from said first and second physical representations, heating fluid temperature set-point values respective to said plurality of sections thus forming a drying rate trajectory;

F. Responsive to said temperature set-point values, controlling the flow rate and temperature of heating fluid in said plurality of sections to maintain said respective set-point values; and G. Operating said papermachine to dry said web within said plurality of sections according to an approximate drying rate trajectory including said lowest critical moisture content at said point of earliest occurrence.

2. A method as described by claim 1 comprising the steps of:

A. Providing a torque to the drying line to drive the drying line

B. Monitoring the magnitude of drive torque delivered to said drying line; and,

C. Adjusting said heating fluid set-point values to maintain said drive torque within predetermined limits.

3. A method of operating a papermachine having an evaporative web drying line including a plurality of heating fluid temperature sections comprising the steps of:

A. Deriving a functional relationship between a reasonable drainage rate range for a type of pulp stock laid on said papermachine to form a given basis weight web and the approximate lowest critical moisture content obtainable in said web at the substantially earliest position along said drying line;

B. Measuring the drainage rate of a particular flow increment of stock to said papermachine being of said type;

C. Determining from said drainage rate measurement from said functional relationship to provide a first value which corresponds to said lowest critical moisture content and a second value corresponding to the point of earliest occurrence thereof along said drying line;

D. Forming a web on said papermachine of said basis weight from said stock flow increment;

E. Determining from said first and second values heating fluid temperature set-point values respective to said plurality of sections thus forming a drying rate trajectory;

F. Responsive to said temperature set point, controlling the flow rate and temperature of heating fluid in said plurality of sections to maintain said respective set-point values; and, G. Operating said papermachine to dry said web within said plurality of sections according to said approximate drying rate trajectory including said lowest critical moisture content at said point of earliest occurrence.

4. A method as described by claim 1 comprising the steps of:

A. Providing a torque of the drying line to drive the drying line

B. Monitoring the magnitude of drive torque delivered to said drying line; and,

C. Adjusting said heating fluid set-point values to maintain said drive torque within predetermined limits.

* * * * *

UNITED STATES PATENT AND TRADEMARK OFFICE

CERTIFICATE OF CORRECTION

PATENT NO. : 4,314,878

DATED : February 9, 1982

INVENTOR(S) : Hong H. Lee

It is certified that error appears in the above—identified patent and that said Letters Patent is hereby corrected as shown below:

Column 2, line 32, following "hardening", insert -- water --.

Column 3, line 59, delete "amount" and insert -- moment --.

Column 9, line 23, delete "i" and insert -- h --.

Column 12, line 64, (Eq.8) following "$({}_cM_c)$" insert -- 2 --.

Column 13, line 41, (Eq. 11) should read $$-- \quad \Delta T_h - \Delta T_i = (\Delta T_i - \Delta T_\ell)^2 \quad --.$$

Column 18, line 25, (Claim 4, line 1, "1" should read -- 3 --;

Signed and Sealed this

*Twenty-fifth* Day of *May 1982*

[SEAL]

*Attest:*

*Attesting Officer*

GERALD J. MOSSINGHOFF

*Commissioner of Patents and Trademarks*